US005931469A

United States Patent [19]

Stichnoth

[11] Patent Number: 5,931,469

[45] Date of Patent: Aug. 3, 1999

[54] METHOD OF PLAYING A BOARD GAME FOR PRACTICING MAKING POSITIVE AND NEGATIVE LIFE CHOICES AND EXPERIENCING THE SUBSEQUENT RESULTS

[76] Inventor: Cynthia Marie Biggerstaff Stichnoth, 17 Woodville Ave., Greenville, S.C. 29607

[21] Appl. No.: 08/858,188

[22] Filed: May 2, 1997

[51] Int. Cl.[6] ..... A63F 3/00

[52] U.S. Cl. ..... 273/242; 273/430; 273/254

[58] Field of Search ..... 273/236, 242, 273/251, 252, 254, 249, 243, 429–432

[56] References Cited

U.S. PATENT DOCUMENTS

| | | | |
|---|---|---|---|
| 3,787,056 | 1/1974 | Hellmann | 273/251 |
| 4,216,594 | 8/1980 | Farley et al. | 273/243 |
| 4,377,287 | 3/1983 | Erwin | 273/252 |
| 4,440,396 | 4/1984 | Frudakis | 273/242 |
| 5,211,402 | 5/1993 | Ferguson et al. | 273/249 |
| 5,350,179 | 9/1994 | Hill et al. | 273/249 |
| 5,533,731 | 7/1996 | Koenig | 273/243 |

OTHER PUBLICATIONS

"Confronting The Unspeakable", Washington Post, May 3, 1981, pp. H1, H4, H5.

"The Ungame" brochure, 1984.

*Primary Examiner*—Benjamin H. Layno

*Attorney, Agent, or Firm*—Hardaway Law Firm, P.A.

[57] ABSTRACT

A method of playing a board game and method for practicing making positive and negative life choices and experiencing the subsequent results. The game board has a plurality of game sites depicted on its playing surface with at least one of the game sites being associated with a therapeutic exercise. A plurality of game pieces are used by players to move between game sites along a series of roadways. When a player stops at a game site, the player is engaged in any therapeutic exercise associated with that site.

22 Claims, 1 Drawing Sheet

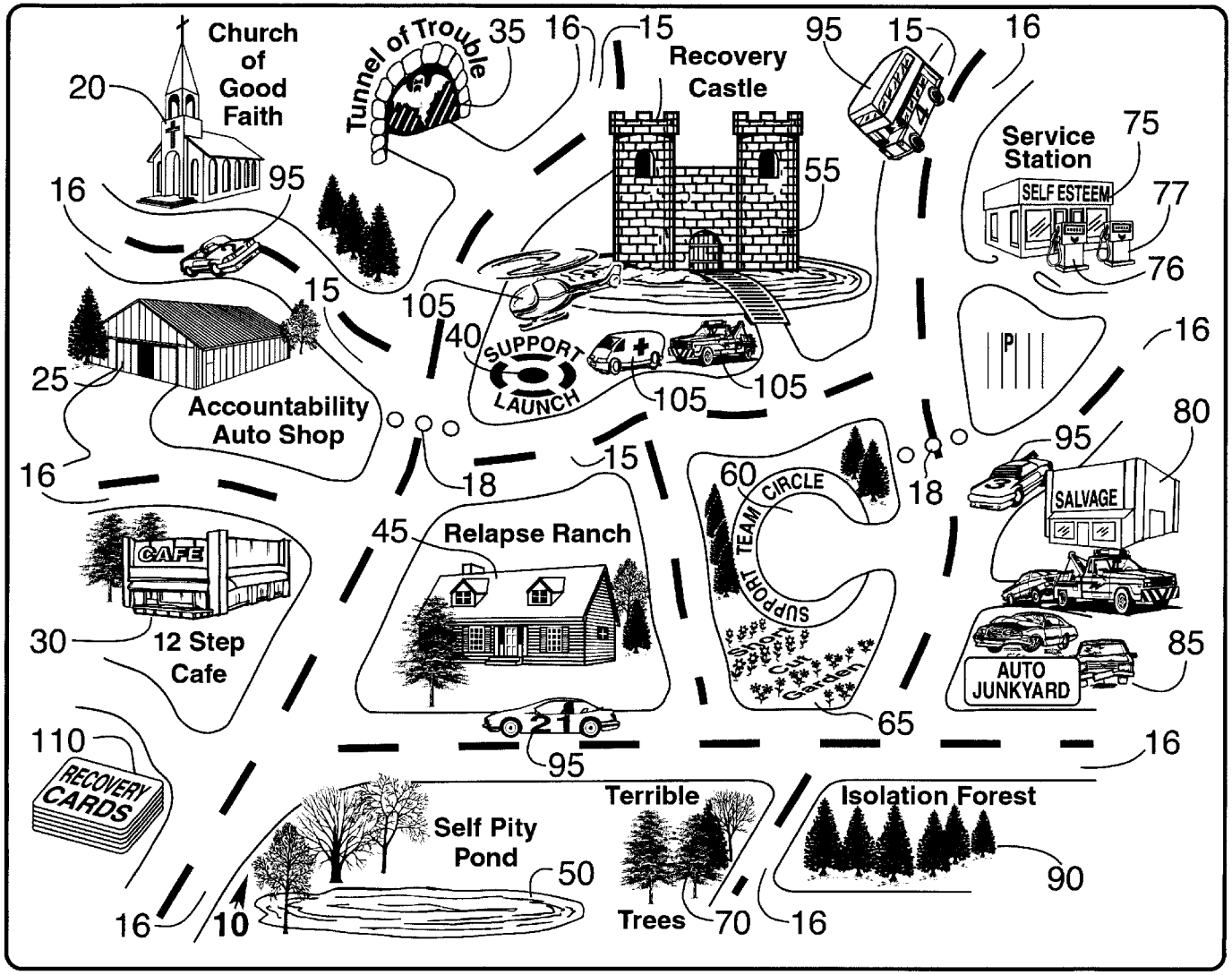
Service Station
SELF ESTEEM
SALVAGE
AUTO JUNKYARD
Isolation Forest
Recovery Castle
CIRCLE
SUPPORT TEAM
Tunnel of Trouble
SUPPORT
LAUNCH
Relapse Ranch
Terrible Trees
Self Pity Pond
Church of Good Faith
Accountability Auto Shop
12 Step Cafe
RECOVERY CARDS
10
15
16
18
20
21
25
30
35
40
45
50
55
60
65
70
75
76
77
80
85
90
95
105
110

METHOD OF PLAYING A BOARD GAME FOR PRACTICING MAKING POSITIVE AND NEGATIVE LIFE CHOICES AND EXPERIENCING THE SUBSEQUENT RESULTS

BACKGROUND OF THE INVENTION

1. Field of the Invention

The invention relates generally to the field of board games, and more particularly to board games used for therapeutic purposes.

2. Description of Related Art

Statistics show that juvenile crime and behavior disorders are increasing at an alarming rate. Correctional and treatment facilities are overburdened and recidivism rates are high. Unfortunately, traditional methods of education and treatment have not suited the needs of certain populations such as the very young, those with attention deficits, and those on the lower scale of intellectual functioning.

The prior art contains examples where board games are used to educate or discourage a particular behavior. For example, U.S. Pat. Nos. 5,350,179 to Hill et al., 5,139,268 to Garnett and 5,071,134 to Burroughs, Jr. disclose board games designed to discourage drug abuse. Similarly, U.S. Pat. Nos. 4,216,966 to MacRae and 4,962,934 to Taylor discourage alcohol abuse. More generally, U.S. Pat. Nos. 4,440,396 to Frudakis, and 1,638,094 to Gilmore encourage self improvement through rewards for good choices or progressing towards a goal.

While the aforementioned games are all useful for their intended purposes, there is room for improvement in the art.

SUMMARY OF THE INVENTION

Health care professionals have found that certain patient populations such as juveniles, persons suffering from attention deficit disorder and persons having a low level of intellectual functioning do not respond as well as others to traditional treatment methods. However, by combining the tenets of play with traditional treatment methods, these populations are more easily engaged in education and treatment.

It is therefore one object of the present invention to engage troubled juveniles and low functioning adults in the exercise of making choices related to problems in their lives.

Another object of the present invention is to integrate the tenets of play with traditional treatment methods.

Yet another object of the present invention is to teach appropriate play and socialization skills.

A further object of the present invention is to build group cohesion by facilitating teamwork and removing competition.

A still further object of the present invention is to provide a non-threatening environment for troubled individuals to practice making both positive and negative choices, to experience both positive and negative consequences, and to ask for help when needed.

Still another object of the present invention is to help troubled individuals learn and practice tools for preventing relapse into negative behavioral patterns as well as learning to live in recovery.

According to the present invention, the foregoing and other objects and advantages are attained by a game board having a plurality of game sites depicted on its playing surface. At least one of the game sites is associated with a therapeutic exercise. A plurality of game pieces are used by players to move between game sites along a series of roadways. When a player stops at a game site, the player is engaged in any therapeutic exercise associated with that site.

Additional objects and advantages will become apparent from a consideration of the following description and drawing.

BRIEF DESCRIPTION OF THE DRAWING

The FIGURE is an elevation view of a game board according to the present invention.

DETAILED DESCRIPTION

With reference to the FIGURE, a game board that achieves all the various objects of the present invention will now be described.

The FIGURE shows a game board 10 according to the present invention. Game board 10 is preferably made from cardboard, paper, or plastic. For ease of storage, game board 10 may be designed to fold or roll up so as to take up less space. The playing surface of game board 10 contains a variety of sites and several roadways 15 connecting the sites. The layout of the sites and roadways 15 on the playing surface is not critical to the invention. In general, the theme or layout should be chosen to suit the aesthetic preferences of potential players. Moreover, the number of sites used could vary depending on the number of therapeutic exercises to be employed or the number of sites dedicated strictly to entertainment or aesthetic purposes.

The game begins with the players choosing a game piece 95 used to navigate roadways 15. In the embodiment shown, game piece 95 is an automobile as it compliments the choice of a roadway for the playing surface. Clearly, any suitable device can be chosen to mark a players position on the playing surface. Preferably game piece 95 is numbered to create a turn sequence for the players. This will reduce the probability of arguments arising since the order is determined by the luck of the draw.

Players can start the game by entering the board at any of starting locations 16, which are identified by places where roadways 15 leave the edge of game board 10. Roadways 15 are not segmented to limit the space a player can move in a turn as in many common board games. Instead, a player will "drive" their car around the playing surface and stop at various sites according to their therapeutic needs. After performing any duties assigned to a site, the player must then get back on roadway 15 and continue the game. To promote participation by the player, a decision marker 18 should be placed at various locations on roadways 15 to force the player to make a decision to either continue on or stop at a site. In the embodiment shown, three dots are used as a decision marker; however, any suitable identifier could be used. There are few rules to traveling the playing surface; however, experience has shown that forbidding players from backing up is effective as it encourages players to drive by more sites on the playing surface. Accordingly, when players drive off the edge of the game board at a starting point 16, they can then enter again at a starting point 16 on an opposing game board edge. The length of a player's turn is generally governed by time. For example, a predetermined block of time is allocated for playing the game and then each player is given a time share from that block. A player may use their entire time share in a single turn or may distribute their time among several turns.

The following paragraphs describe the therapy techniques used with the sites shown in the FIGURE. It is envisioned that additional or alternative techniques would be employed depending on the application. For example, the techniques used for players suffering from poor self-esteem or educational problems would likely be different from players having problems with sexual aggression or an alternative form of violence. In addition, all of the sites shown in the FIGURE are associated in some way with a therapeutic treatment. Alternative embodiments may choose to have additional sites used strictly for entertainment, aesthetic, or some other purpose.

In the embodiment shown, when players stop at Relapse Ranch 45, the therapeutic exercise is focused on any and all situations that make it easier for the player to make negative choices. The player is asked to identify situations that facilitate or encourage negative choices. In addition, the player is asked to explain why a negative choice was made, either real or hypothetical.

After completing the discussion, the player must go directly to Auto Salvage 80 where the player must identify ways that the player can recover from, and make restitution to others for, the consequences of the negative choice. Auto Salvage 80 is intended to represent a court remanded stay at a residential treatment facility, therefore, the player is asked to explain in detail areas in life where changes are needed. Moreover, the player is asked to discuss those things that are important in life and that the player will miss while the player stays at Auto Salvage 80.

If a player chooses to visit Relapse Ranch 45 twice, The player must go directly to Auto Junkyard 80 and remain there for the rest of the game. Auto Junkyard 80 is intended to represent lifetime incarceration. The player is asked to contemplate and discuss how a negative choice can have potentially lifetime effects.

When a player visits Service Station 75, the therapy relates to the area of self-esteem. Service Station 75 has both a negative self-esteem pump 76 and a positive self-esteem pump 77. The player must choose to fill up either with negative or positive self esteem and then explain why the choice was made and how the chosen self-esteem enhances life. Finally, the player is asked to explain what effect the chosen self-esteem has on deciding what site to stop at next.

A stop at Short Cut Garden 65 causes the player to get stuck there. To leave that site, the player must ask a peer player for help after explaining why help is needed. The chosen peer will then drive a support piece (not shown) from Support Launch 40 to Short Cut Garden 45 to pull the stuck player out of the garden. Short Cut Garden 65 is designed to demonstrate to the player that they cannot take short cuts in their treatment. Moreover, players are given a venue to seek help from others and to give help to others in need.

The support 105 piece could be any type of rescue device. Vehicles such as an ambulance, wrecker truck and helicopter are used with the embodiment shown. The type of support pieces chosen should preferably be compatible with the game theme.

Self Pity Pond 50 provides players a non-threatening way to admit they indulge in self-pity. When players visit this site they are asked to discuss why they are indulging in self-pity. Players then have the option of leaving this site by themselves or requesting support from a peer player. If support is requested, the peer player will drive a support piece from Support Launch 40 to Self Pity Pond 50 to pull the stuck player from the water while simultaneously encouraging the stuck player with self-esteem boosting comments.

By stopping at Accountability Auto Stop 25, players empower themselves to admit high risk behaviors or thoughts and accept accountability without having to be confronted first. At this stop, the players are required to explain what they need to take accountability for, whether realistic or hypothetical, and why they have decided to be accountable now.

When players visit the Church of Good Faith, they are experimenting with their own religious beliefs or belief in a "higher power". Players are asked to explain why they chose to stop here and discuss any expectations they have of religious beliefs as a form of support.

Twelve Step Cafe 30 is a mechanism by which traditionally therapeutic twelve step concepts are integrated into the game. A deck of 110 cards is included with the game on which questions related to the tenets of basic twelve step programs are printed. When stopping at this site, players are asked to take a card and answer the question printed on it. In addition, players are asked to apply their answers to their need to avoid relapsing into more negative choices.

Entering Recovery Castle 55 is the goal all players should work toward. According to the embodiment shown, Players are told there is a great knight in shining armor on the other side of the castle door and that to enter the castle, players must explain to the knight how and why they have chosen to practice recovery from negative choices for life. Specifically, a player wanting to enter Recovery Castle 55 must give their explanation. Then, the player's peers and therapist may ask questions they think the knight would ask. If the peers and therapist believe the player is truly practicing recovery, then the player will be allowed to enter. Preferably, only those players nearing the end of their therapy would be allowed to enter Recovery Castle 55 to maintain the value of Recovery Castle 55 as a goal.

Players can visit Isolation Forest 90 when they want to separate themselves from support or negative influences. When seeking isolation, players are asked to explain why they want to be isolated and must describe ways they isolate themselves in real life. Preferably, players are encouraged to leave Isolation Forest 90 as soon as possible to avoid encouraging extended isolation.

Support Team Circle 60 is designed as a place where players can go to ask for help or support from other players and/or a therapist. In asking for help, players are asked to discuss what issue drove them to come to Support Team Circle 60 and who they would like on their support team. To facilitate teamwork and social skills, a player should ask at least two peer players for advice in dealing with the issue they identified.

When players choose to visit Tunnel of Trouble 35, they are given an opportunity to experiment with undesired choices or behavior that is not necessarily negative or criminal. However, such undesired behavior is often the type that leads to negative or criminal behavior in the future. Players are asked to explain the choices or behavior they are seeking and their motivation for seeking same. A player's peers then engage the player in a discussion by providing insight into how such choices or behavior could negatively influence future choices or behavior.

Terrible Trees 70 provides an opportunity for a therapist to provide a player with a hypothetical high risk scenario to work through. The player is asked to explain how they would be drawn into the negative behaviors or choices presented by the scenario, or, alternatively, how they would avoid negative behaviors or choices. If the player's peers feel the player is being dishonest, the player is asked to further explain those suspect areas.

The above description is given in reference to board game that can be used for therapeutic purposes. However, it is understood that many variations are apparent to one of ordinary skill in the art from a reading of the above specification and such variations are within the spirit and scope of the invention as defined by the following appended claims:

That which is claimed:

1. A method for practicing making positive and negative life choices and experiencing the subsequent results, comprising the steps of:

providing a game board having a playing surface, said playing surface having a plurality of game sites, at least one of said game sites associated with a therapeutic exercise, said game sites connected via a plurality of roadways;

moving between said game sites by moving a game piece along said roadways, said game piece representing a player;

engaging said player in any said associated therapeutic exercise when said player visits a particular said game site;

siad engaging step above helping player to gain insight for preventing relapse into negative behavioral patterns.

2. The method of claim 1, wherein said game sites are selected from the group consisting of:

a church, a ranch, a service station, a garden, a body of water, an accountability stop, a cafe, a castle, a forest, a circle, a launch pad, a tunnel, a clump of trees, an auto salvage and a junkyard.

3. The method of claim 1, wherein said therapeutic exercises are selected from the group consisting of:

exploring religious beliefs, exploring situations that make it easy for said player to make negative choices, exploring areas in life where changes are needed, identifying methods to make said life changes, exploring the loss of things important in life as a result of a negative choice, exploring the effect of self-esteem, exploring the effect of giving and receiving peer support, exploring the consequences of taking short-cuts in therapy, exploring the effect and use of self-pity, exploring the effect of accountability, exploring the role of basic twelve step recovery concepts, exploring the choice of recovery, exploring the effect of isolation, exploring the effect of undesirable choices, simulating scenarios likely to lead to negative choices and exploring how a negative choice can have life-long effects.

4. The method of claim 1, wherein:

when said player visits a first said game site, said player is required to perform the following steps:

identify situations that assist in making negative choices;

explain in detail why a negative choice was made; and go directly to a second said game site and perform the following steps:

identify ways to recover from and make restitution for the consequences of said negative choices;

explain in detail areas in life where changes are needed; and explain in detail the things in life that are important and will be missed;

if said player visits said first said game site twice, said player must go directly to a third said game site and explain in detail the potential life changing effects of said negative choice.

5. The method of claim 1, wherein when said player visits one of said game sites, said player is required to perform the following steps:

choose to receive one of negative and positive self-esteem;

explain why said self-esteem choice was made;

explain how said self-esteem choice is used; and explain how said self-esteem choice influences a decision to stop visit a subsequent game site.

6. The method of claim 1, wherein when said player visits a first said game site, said player cannot leave said first said game site and is required to perform the following step:

ask a peer player for assistance after explaining why help is needed;

whereby said peer moves a support piece from a second said game site to pull said player from said first said game site.

7. The method of claim 1, wherein when said player visits a first said game site, said player is required to perform the following steps:

explain in detail how and why said player engages in self-pity; and choose between one of leaving said first said game site alone and asking a peer player for assistance;

whereby if said player asks for assistance, said peer moves a support piece from a second said game site to pull said player from said first said game site simultaneously boosting said player's self esteem.

8. The method of claim 1, wherein when said player visits one of said game sites, said player is required to perform the following steps:

explain in detail where accountability is needed; and explain in detail why accountability is being taken now.

9. The method of claim 1, wherein when said player visits one of said game sites, said player is required to perform the following steps:

draw a recovery card, said recovery card containing a question based on basic tenets of twelve step recovery concepts; and answer said question on said recovery card and apply said answer to the area of relapse prevention.

10. The method of claim 1, wherein when said player visits one of said game sites, said player is required to perform the following steps:

explain how and why recovery has been chosen for life; and answer questions from peers and a therapist;

whereby said player can enter said visited game site if said peers and said therapist agree said player is truly practicing recovery.

11. The method of claim 1, wherein when said player visits one of said game sites, said player is required to perform the following steps:

explain in detail why isolation is sought and relate to isolation techniques used elsewhere in life; and leave said visited game site as soon as possible so as not to encourage extended isolation practices.

12. The method of claim 1, wherein when said player visits one of said game sites, said player is required to perform the following steps:

explain in detail an issue for which support from peers and a therapist is sought; and identify at least two individuals from the group consisting of said peers and said therapist for which advice will be sought for dealing with said issue.

13. The method of claim 1, wherein when said player visits one of said game sites, said player is required to perform the following steps:

explain in detail undesired choices being considered;

explain in detail the motivation behind said undesired choices; and respond to advice from peers on how said undesired choices could influence future choices.

14. The method of claim 1, wherein when said player visits one of said game sites, said player is required to perform the following steps in response to a hypothetical scenario provided by a therapist that is likely to lead to negative choices:

explain any choices made if placed in said scenario; and explain decision making process in response to any question of honesty from peers and said therapist.

15. The method of claim 1, wherein when said player visits one of said game sites, said player is required to perform the following steps:

explain in detail why said game site was chosen for a visit; and discuss expectations of religious beliefs as a form of support.

16. A method for practicing making positive and negative life choices and experiencing the subsequent results, comprising the steps of:

providing a game board having a playing surface, said playing surface including:

a plurality of game sites, at least one of said game sites associated with a therapeutic exercise; said therapeutic exercises are selected from the group consisting of:

exploring religious beliefs, exploring situations that make it easy for said player to make negative choices, exploring areas in life where changes are needed, identifying methods to make said life changes, exploring the loss of things important in life as a result of a negative choice, exploring the effect of self-esteem, exploring the effect of giving and receiving peer support, exploring the consequences of taking short-cuts in therapy, exploring the effect and use of self-pity, exploring the effect of accountability, exploring the role of basic twelve step recovery concepts, exploring the choice of recovery, exploring the effect of isolation, exploring the effect of undesirable choices, simulating scenarios likely to lead to negative choices and exploring how a negative choice can have life-long effects;

a plurality of roadways connecting said game sites;

a plurality of game pieces for moving between said game sites along said roadways, each said game piece representing a player;

whereby, upon visiting a particular said game site, said player engages in any said therapeutic exercise associated therewith;

moving between said game sites by moving a game piece along said roadways, said game piece representing a player;

engaging said player in any said associated therapeutic exercise when said player visits a particular said game site.

17. The method of claim 16, wherein said game board pieces are numbered indicating a turn sequence for said players.

18. The method of claim 16, wherein said roadways include a decision marker instructing said player to choose whether to continue moving along said roadways or stop at one of said game sites.

19. The method of claim 16, wherein said game board has a perimeter and wherein said perimeter has a plurality of entry points to said roadways.

20. The method of claim 16, further comprising a plurality of support pieces representing help from said player's peers.

21. The method of claim 16, further comprising a plurality of recovery cards containing questions based on basic tenets of twelve step recovery concepts.

22. A method for practicing making positive and negative life choices and experiencing the subsequent results, comprising the steps of:

providing a game board having a playing surface and a perimeter, said playing surface including:

a plurality of game sites, at least one of said game sites associated with a therapeutic exercise; said therapeutic exercises are selected from the group consisting of:

exploring religious beliefs, exploring situations that make it easy for said player to make negative choices, exploring areas in life where changes are needed, identifying methods to make said life changes, exploring the loss of things important in life as a result of a negative choice, exploring the effect of self-esteem, exploring the effect of giving and receiving peer support, exploring the consequences of taking short-cuts in therapy, exploring the effect and use of self-pity, exploring the effect of accountability, exploring the role of basic twelve step recovery concepts, exploring the choice of recovery, exploring the effect of isolation, exploring the effect of undesirable choices, simulating scenarios likely to lead to negative choices and exploring how a negative choice can have life-long effects;

a plurality of roadways connecting said game sites, said perimeter having a plurality of entry points to said roadways;

a plurality of numbered game pieces for moving between said game sites along said roadways, each said game piece representing a player, said numbers indicating a turn sequence for said players;

a decision marker located on said roadways instructing said player to choose whether to continue moving along said roadways or stop at one of said game sites;

a plurality of support pieces representing help from said player's peers; and a plurality of recovery cards containing questions based on basic tenets of twelve step recovery concepts; whereby, upon visiting a particular said game site, said player engages in any said therapeutic exercise associated therewith;

moving between said game sites by moving a game piece along said roadways, said game piece representing a player;

engaging said player in any said associated therapeutic exercise when said player visits a particular said game site.

* * * * *